US010153107B2

(12) United States Patent
Okano

(10) Patent No.: US 10,153,107 B2
(45) Date of Patent: Dec. 11, 2018

(54) MANIPULATION DEVICE

(71) Applicant: FURUNO ELECTRIC CO., LTD., Nishinomiya, Hyogo (JP)

(72) Inventor: Shinichi Okano, Akashi (JP)

(73) Assignee: FURUNO ELECTRIC COMPANY LIMITED, Nishinomiya (JP)

( * ) Notice: Subject to any disclaimer, the term of this patent is extended or adjusted under 35 U.S.C. 154(b) by 58 days.

(21) Appl. No.: 15/407,813

(22) Filed: Jan. 17, 2017

(65) Prior Publication Data

US 2017/0213670 A1 Jul. 27, 2017

(30) Foreign Application Priority Data

Jan. 25, 2016 (JP) ..... 2016-011404

(51) Int. Cl.

| | |
|---|---|
| ***H01H 19/06*** | (2006.01) |
| ***H01H 19/14*** | (2006.01) |
| ***G05G 1/10*** | (2006.01) |
| ***H01H 25/04*** | (2006.01) |

(52) U.S. Cl.

CPC ..... *H01H 19/06* (2013.01); *G05G 1/10* (2013.01); *H01H 25/04* (2013.01); *H01H 19/14* (2013.01); *H01H 2025/045* (2013.01)

(58) Field of Classification Search

CPC ..... H01H 19/06; H01H 19/14; H01H 25/04; H01H 2025/045; G05G 9/02; G05G 1/10; H04B 2001/3894

See application file for complete search history.

(56) References Cited

U.S. PATENT DOCUMENTS

| | | | | |
|---|---|---|---|---|
| 2,908,776 | A * | 10/1959 | Nolden | H01H 25/06 200/16 A |
| 6,918,313 | B2 * | 7/2005 | Kojima | G05G 1/10 74/10.22 |
| 7,252,526 | B2 * | 8/2007 | Watanabe | G05G 1/105 439/271 |
| 9,679,717 | B2 * | 6/2017 | Ishigure | H01H 19/14 |
| 2009/0078551 | A1 * | 3/2009 | Kang | G06F 3/0338 200/336 |
| 2013/0112532 | A1 * | 5/2013 | Suzuki | G05G 9/047 200/4 |
| 2018/0083393 | A1 * | 3/2018 | Kobayashi | H01R 13/71 |

FOREIGN PATENT DOCUMENTS

| | | | | |
|---|---|---|---|---|
| DE | 3540794 | A1 * | 5/1987 | F16J 15/4478 |
| DE | 4328659 | A1 * | 3/1995 | F16J 3/041 |
| DE | 10147793 | C1 * | 2/2003 | H01H 25/065 |

(Continued)

OTHER PUBLICATIONS

Machine translation of JP 2012-33357 A obtained on May 7, 2018. (Year: 2018).*

*Primary Examiner* — Adam D Rogers

(74) *Attorney, Agent, or Firm* — Studebaker & Brackett PC

(57) ABSTRACT

A manipulation device includes a rotary knob, a button and a waterproofing ring. The rotary knob rotatable about a rotational axis. The button having a center axis on the rotational axis of the rotary knob. The waterproofing ring that waterproofs a gap between the rotary knob and the button. The waterproofing ring rotating with the rotary knob, and the waterproofing ring being held in contact with the button and the rotary knob.

14 Claims, 5 Drawing Sheets

(56) References Cited

FOREIGN PATENT DOCUMENTS

| | | | | | |
|---|---|---|---|---|---|
| DE | 102013208088 | A1 | * | 11/2014 | ..... B60K 35/00 |
| JP | 09198952 | A | * | 7/1997 | |
| JP | 2009-238707 | A | | 10/2009 | |
| JP | 2010108801 | A | * | 5/2010 | |
| JP | 2012033357 | A | * | 2/2012 | |
| JP | 2015046483 | A | * | 3/2015 | |

* cited by examiner

MANIPULATION DEVICE

CROSS-REFERENCE TO RELATED APPLICATIONS

This application claims priority to Japanese Patent Application No. 2016-011404 filed on Jan. 25, 2016. The entire disclosure of Japanese Patent Application No. 2016-011404 is hereby incorporated herein by reference.

BACKGROUND

Field of the Invention

The present invention relates to a manipulation device. More specifically, the present invention relates to the configuration of a manipulation device that has a waterproof function and is suited to a marine-use electronic device, for example.

Background Information

Multifunction manipulation devices equipped with a waterproof function have been known in the past. Japanese Laid-Open Patent Application No. 2009-238707 (Patent Literature 1) discloses a composite manipulation device comprising a rotary dial and a push button knob. The manipulation device in Patent Literature 1 is equipped with a case, a rotary dial having a shaft support that is inserted rotatably into an opening in the case and an opening provided in the center of the shaft support, a rotor that is linked to the shaft support, an attachment base on which the case is placed, and a push button knob installed movably up and down in the opening. A projecting part is provided to a part of the opening that projects towards the opening relative to the shaft support. With the above manipulation device, an anti-drip member is installed that is composed of an elastic member having a cylindrical anti-drip constricted part that is constricted between the lower face of the projecting part and the upper face of the rotor, and a cover plate part that covers the space on the inside of the anti-drip constricted part and on which the push button knob is placed. This configuration prevents any liquids that penetrate through the gap between the push button knob and the opening of the rotary dial from penetrating to the rotor side.

Also known in the art is providing a bellows mechanism so as to cover a joystick, which is a switch for detecting pivoting, in order to waterproof this switch.

SUMMARY

With the manipulation device in Patent Literature 1, the anti-drip member is supported by a plurality of (many) members. Therefore, the rotary dial used for rotary operation and the manipulation part used for operation other than rotary operation are designed so as to prevent water from penetrating through the gap between these parts, and this results in a complicated structure, so in this respect there is room for improvement. Also, friction is generated between the anti-drip member and the plurality of parts during the rotary operation of the rotary dial, so there is the risk of an increase in rotational resistance in the rotary dial, causing the parts to wear out.

Furthermore, Patent Literature 1 does not assume operation in which the push button knob is pivoted, so even if it is applied to a configuration that allowed pivoting operation, it is believed that the waterproof function could not be fully realized. Also, if a bellows is provided for waterproofing as mentioned above, it ends up being difficult to reduce the size of the manipulation device.

The present invention is conceived in light of the above situation, and it is an object thereof to provide, simply and inexpensively, a manipulation device that is compact, is waterproof and ease to manipulate, and allows rotary operation as well as operation other than the rotary operation.

The problem to be solved by the present invention is as discussed above, and the means for solving this problem, and the effect thereof, will now be described.

A first aspect of the present invention provides a manipulation device with the following configuration. Specifically, this manipulation device comprises a rotary knob, a button, and a waterproofing ring. The rotary knob rotatable about a rotational axis. The button has a center axis on the rotational axis of the rotary knob. The waterproofing ring that waterproofs a gap between the rotary knob and the button. The waterproofing ring rotates with the rotary knob, and is held in contact with the button and the rotary knob.

buttonbuttonbuttonbutton Thus providing the waterproofing ring that contacts with and is supported by the rotary knob, and the button, ensures that the rotary knob and the button will be easy to operate, while preventing water from penetrating into the interior through the gap between the rotary knob and the button. As a result, a multifunction manipulation device that is waterproof with a simple and inexpensive configuration.

The above-mentioned manipulation device can have the following configuration. Specifically, the rotary knob has an annular protrusion that protrudes substantially parallel to the rotational axis of the rotary knob. The waterproofing ring has a groove. The annular protrusion of the rotary knob is fitted into the groove of the waterproofing ring. Also, the above-mentioned manipulation device can have the following configuration. Specifically, the waterproofing ring has an annular protrusion that protrudes substantially parallel to the rotational axis of the rotary knob. The rotary knob has a groove. The annular protrusion of the waterproofing ring is fitted into the groove of the rotary knob.

Consequently, since the rotary knob and the waterproofing ring are fitted, good waterproofness can be attained and fixing can be accomplished with a simple configuration.

The above-mentioned manipulation device preferably has the following configuration. Specifically, the waterproofing ring has an annular protrusion that protrudes substantially parallel to the rotational axis of the rotary knob. The button has a groove. The annular protrusion of the waterproofing ring is fitted into the groove of the button.

Consequently, since the rotary knob and the waterproofing ring are fitted, good waterproofness can be attained and fixing can be accomplished with a simple configuration.

The above-mentioned manipulation device preferably has the following configuration. Specifically, an annular projection that protrudes inside and outside in a radial direction of the waterproofing ring is provided on the protrusion of the waterproofing ring. The annular projection is pressed against an inner wall of the groove of the button to cause the button and the waterproofing ring to be fitted.

Consequently, compared to when connecting to the button with the entire projection of the waterproofing ring, the contact surface area between the waterproofing ring and the button is smaller, so there is less rotational resistance of the button with respect to the waterproofing ring when the rotary knob is turned, and the rotary knob can be turned with less force. As a result, the manipulation device is easier to operate. Also, since the incursion of water into the interior is prevented while the waterproofing ring and the button can be slid at the contact portion between the waterproofing ring and the button, an operation other than the rotary operation can be easily performed with the button while waterproofness is maintained. As a result, a manipulation device that is both waterproof and easy to operate can be obtained.

With the above-mentioned manipulation device, it is preferable if a sealed space is formed between the waterproofing ring and the button.

Consequently, the sealed space can be used for the enclosure of a lubricant or the like, for example. Also, by enclosing a lubricant in the sealed space, slidability can be maintained while improving the waterproofness of the manipulation device.

With the above-mentioned manipulation device, it is preferable if the button is tiltable relative to the center axis of the button.

Specifically, as discussed above, a configuration that allows the button and the waterproofing ring to slide is favorable when there is provided a button that is operated so as to tilt outward in the radial direction, as with a joystick.

With the above-mentioned manipulation device, it is preferable if the button is pushable in a direction of the center axis of the button.

Specifically, as discussed above, a configuration that allows the button and the waterproofing ring to slide is favorable when there is provided a button that is operated by being pushed in, as with a push switch.

With the above-mentioned manipulation device, it is preferable if the button is both tiltable relative to the center axis of the button and pushable in a direction of the rotational axis of the rotary knob.

Specifically, as discussed above, a configuration that allows the button and the waterproofing ring to slide is particularly favorable when there is provided a multifunction button that is operated so as to tilt outward in the radial direction, as with a joystick, and that is operated by being pushed in, as with a push switch.

The above-mentioned manipulation device preferably has the following configuration. Specifically, the rotary knob connected to a first detector configured to detect a rotary operation. The button connected to a second detector configured to detect a different operation from the rotary operation detected by the first detector.

Consequently, a multifunction manipulation device that is waterproof with a simple and inexpensive configuration.

A second aspect of the present invention provides a marine-use electronic device comprising the above-mentioned manipulation device.

Specifically, as discussed above, a configuration that allows the button and the waterproofing ring to slide is extremely favorable in a multifunction manipulation device provided to a marine-use electronic device that needs to be waterproof.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
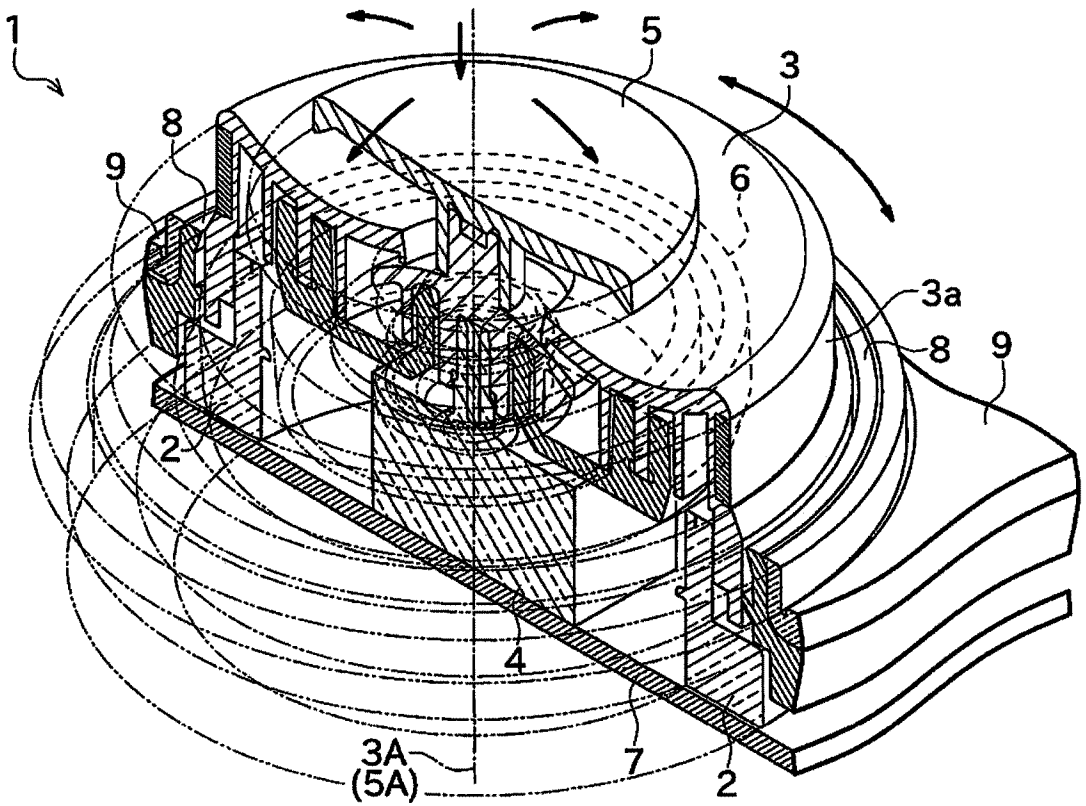
FIG. 1 is a cross sectional oblique view of the overall configuration of a multifunction joystick pertaining to an embodiment of the present invention.
Figure 2:
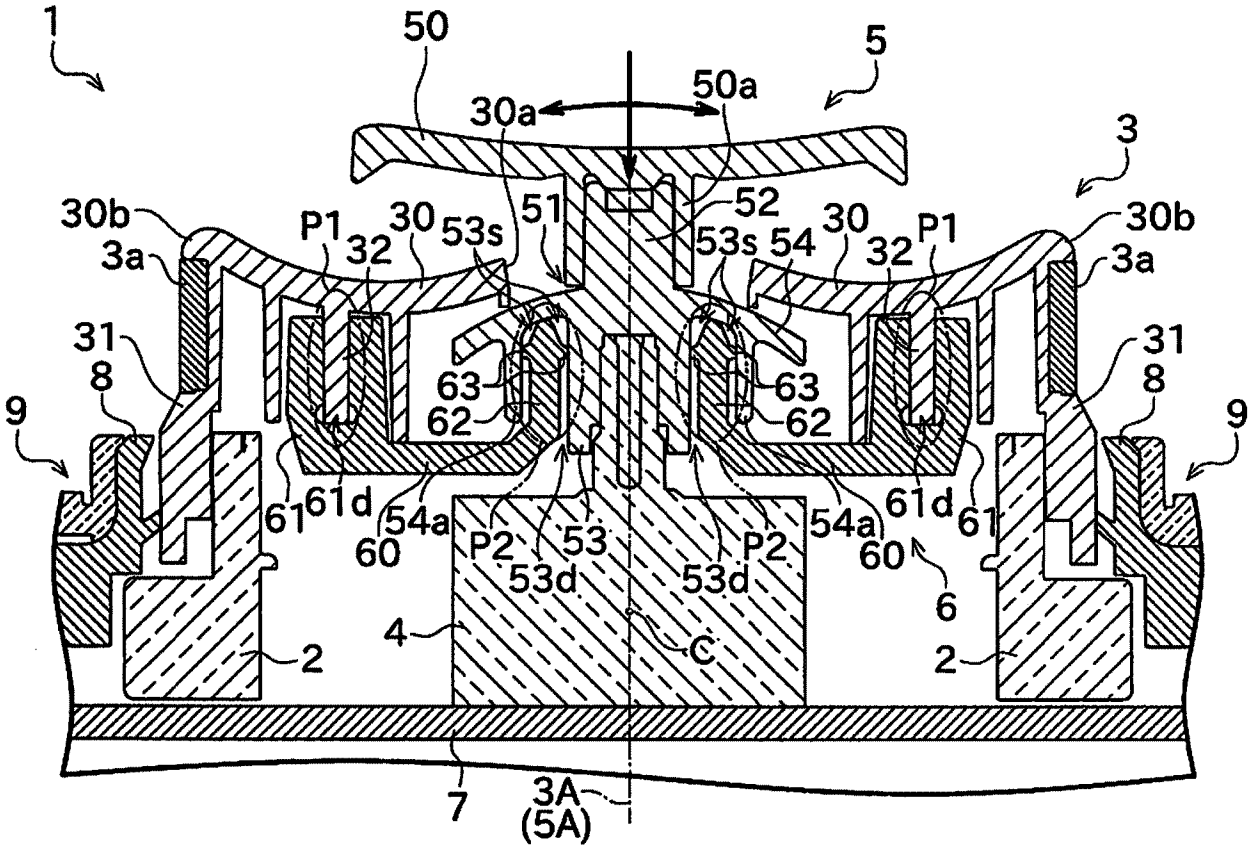
FIG. 2 is a cross section of a multifunction joystick.

FIG. 1 is an oblique view of the overall configuration of a multifunction joystick (manipulation device) 1 pertaining to an embodiment of the present invention. FIG. 2 is a cross section of the multifunction joystick 1.

As shown in FIGS. 1 and 2, the multifunction joystick 1 comprises a rotary encoder (first detector) 2, an operation dial (rotary knob) 3, a joystick position sensor (second detector) 4, an operation knob (button) 5, and a packing (waterproofing ring) 6.

The marine-use electronic device that is equipped with the multifunction joystick 1 comprises an electronic circuit board 7 and an instrument panel face 9. The multifunction joystick 1 is installed on the electronic circuit board 7, which is formed in a flat shape, and is disposed so as to protrude from the instrument panel face 9. A circular through-hole is made in the instrument panel face 9, and a waterproof connection member 8 is disposed between this through-hole and the multifunction joystick 1.

To facilitate description in this Specification, the orientation in which the multifunction joystick 1 protrudes from the instrument panel face 9 will be called "up," and the opposite orientation will be called "down." "Up" could also be referred to as the direction moving away from the electronic circuit board 7, and "down" the direction moving closer to the electronic circuit board 7. However, this explanation of orientation is not intended to limit the multifunction joystick 1 to being disposed facing up, and the multifunction joystick 1 can be disposed in various orientations with respect to the marine-use electronic device.

As shown in FIGS. 1 and 2, the rotary encoder 2 and the joystick position sensor 4 are installed on the electronic circuit board 7. The rotary encoder 2 has a hollow form, with the joystick position sensor 4 being disposed in its center part. The rotary encoder 2 and the joystick position sensor 4 are electrically connected to a signal circuit (not shown) formed on the electronic circuit board 7.

The operation dial 3 is connected to the rotary encoder 2, and this rotary encoder 2 is able to detect rotary operation around the rotational axis 3A of the operation dial 3.

The operation knob 5 is connected to the joystick position sensor 4, and this operation knob 5 is in its neutral position along the center axis 5A in a state in which no operational force is being exerted in a tilting direction. The center axis 5A of the operation knob 5 is disposed to coincide with the rotational axis 3A of the operation dial 3.

The joystick position sensor 4 can detect on operation in which the operation knob 5 is tilted to the outside in the radial direction (any direction within 360 degrees) from the neutral position, and an operation in which the operation knob 5 is pushed in the direction of the center axis 5A. The operation of tilting the operation knob 5 and the operation of pushing in the operation knob 5 are both operations that are different from the rotary operation of the operation dial 3 around the rotational axis 3A detected by the rotary encoder 2.

The operation dial 3 will be described in detail. As shown in FIG. 2, the operation dial 3 comprises a plate component 30, an outer cylindrical component 31, and a fixing rib (protrusion) 32.

The plate component 30 is formed in a disk shape, and is disposed so that its center coincides with the rotational axis 3A and its thickness direction is parallel to the rotational axis 3A. A circular hole 30*a* passes through the center of the plate component 30. As shown in FIG. 2, the middle part in the radial direction of the upper face of the plate component 30 is formed so that it curves downward.

The outer cylindrical component 31 is formed in a cylindrical shape around the rotational axis 3A, and is formed extending downward from the outer end in the radial direction of the plate component 30. The outer cylindrical component 31 has an upper part formed relatively small in diameter and thin, and a lower part that is larger in diameter and thicker than the upper part, and is formed so as to connect to the rotary encoder 2 at the lower part. The plate component 30 has a flange 30*b* that protrudes slightly outward in the radial direction from the place connected to the outer cylindrical component 31. An annular rubber piece 3*a* mounted around the outside of the outer cylindrical component 31 is disposed under the flange 30*b*, which prevents the user's fingers from slipping when operating the operation dial 3.

The fixing rib 32 is formed in a cylindrical shape around the rotational axis 3A, and is formed extending down and parallel to the rotational axis 3A from the lower face of the plate component 30. The fixing rib 32 is formed in a closed annular shape surrounding the rotational axis 3A when viewed in a direction parallel to the rotational axis 3A. The fixing rib 32 is disposed to the outside in the radial direction of the circular hole 30*a* formed in the plate component 30, and to the inside in the radial direction of the outer cylindrical component 31.

The operation dial 3 configured as above is capable of rotary operation around the rotational axis 3A, turning either clockwise or counter-clockwise.

The operation knob 5 will now be described in detail. As shown in FIG. 2, the operation knob 5 comprises a top part 50 and a connecting member 51.

The top part 50 is formed in a disk shape, and is disposed so that its center coincides with the center axis 5A and its thickness direction is parallel to the center axis 5A. A curved recess is formed in the center of the upper face of the top part 50. A hollow cylindrical part 50*a* is formed protruding downward from the lower face of the top part 50, and the connecting member 51 can be fixed to this cylindrical part.

The connecting member 51 is disposed between the joystick position sensor 4 and the top part 50, and the operational force exerted by the user on the top part 50 can be transmitted to the joystick position sensor 4. The connecting member 51 is configured such that an upper connection component 52, a lower connection component 53, and an umbrella component 54 are formed integrally.

The upper connection component 52 is formed in the shape of a circular column, and its axis is disposed so as to coincide with the center axis 5A. The upper connection component 52 is inserted into the cylindrical part 50*a* formed on the top part 50, and can thereby be connected to the center portion of the lower face of the top part 50.

The lower connection component 53 is formed in the shape of a circular column, and its axis is disposed so as to coincide with the center axis 5A. An insertion hole that allows the movable part of the joystick position sensor 4 to be non-rotatably inserted is formed in the lower part of the lower connection component 53.

The umbrella component 54 is formed as a spherical shell that spreads outward in the radial direction from the boundary portion of the upper connection component 52 and the lower connection component 53. A cylindrical rib 54*a* is formed extending downward from the lower face of the umbrella component 54 and parallel to the center axis 5A, and the lower connection component 53 is disposed on the inside in the radial direction of this rib 54*a*. An annular sliding groove 53*d* that opens on the lower side is formed between the lower connection component 53 and the rib 54*a*.

As shown in FIG. 1, the operation knob 5 can be tilted a specific amount in any direction outward in the radial direction from the center axis 5A (pivot operation). As discussed above, the movable part of the joystick position sensor 4 can be inserted into the insertion hole formed in the operation knob 5, so the pivot center when the operation knob 5 pivots coincides with the pivot center of the movable part of the joystick position sensor 4 (the center C shown in FIG. 2). Also, when the operation knob 5 is tilted outward in the radial direction from the center axis 5A, the cylindrical part 50*a* of the operation knob 5 hits the edge of a circular hole 30*a* formed in the plate component 30 of the operation dial 3. Therefore, the pivot stroke of the operation knob 5 is mechanically limited by the circular hole 30*a*.

The operation knob 5 can also be push in by a specific amount in the downward direction of the center axis 5A (push-in operation).

Figure 4:
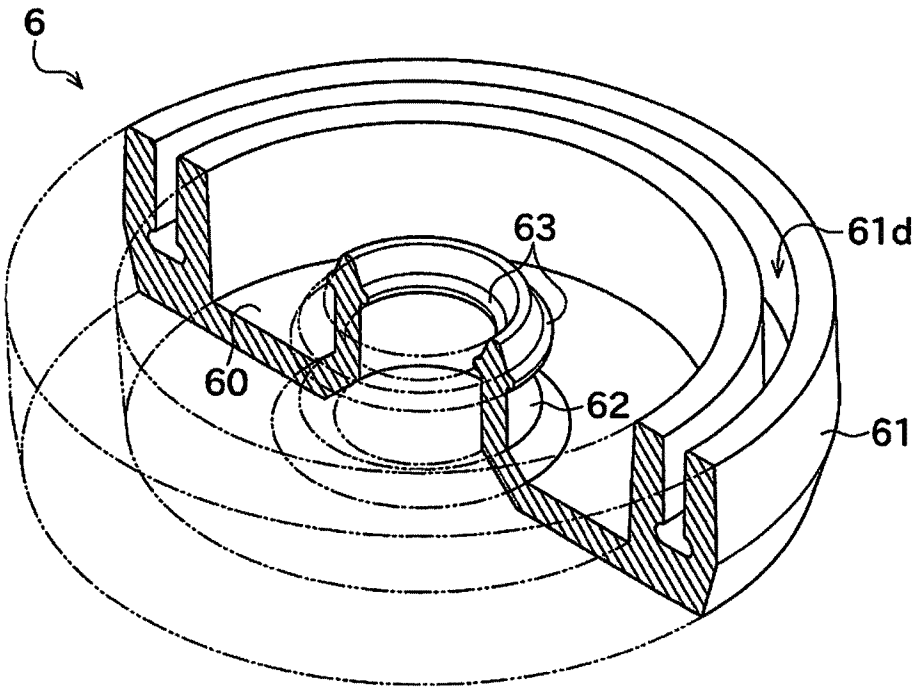
FIG. 4 is an oblique view of the packing.

As shown in FIG. 4, the packing 6 integrally comprises a plate component 60, a fixing cylinder 61, and a sliding rib (protrusion) 62. This packing 6 is formed in an annular shape, and is made of waterproof silicone.

The plate component 60 is formed in a disk shape, and as shown in FIG. 2, etc., it is disposed so that its center coincides with the rotational axis 3A and its thickness direction is parallel to the rotational axis 3A. A circular through-hole is formed in the center of the plate component 60, and the lower connection component 53 of the operation knob 5 and so forth are inserted into this through-hole.

The fixing cylinder 61 is formed extending above and parallel to the rotational axis 3A from the end on the outside in the radial direction of the plate component 60. An annular fixing groove 61*d* whose center is the rotational axis 3A is formed in the fixing cylinder 61. The upper side of this fixing groove 61*d* is open, and the fixing rib 32 of the operation dial 3 is inserted from the upper side into this fixing groove 61*d*.

The sliding rib 62 is formed in a cylindrical shape parallel to the rotational axis 3A, and is formed extending above and parallel to the rotational axis 3A from the end on the inside in the radial direction of the plate component 60. The sliding rib 62 is formed in a closed annular shape surrounding the rotational axis 3A when viewed in a direction parallel to the rotational axis 3A. This sliding rib 62 is inserted into the sliding groove 53*d* formed in the connecting member 51.

The electronic circuit board 7 is formed in a flat shape, and is disposed on the lower side of the joystick position sensor 4 and the rotary encoder 2. The joystick position sensor 4 and the rotary encoder 2 are electrically connected as needed to the electronic circuit formed on this electronic circuit board 7.

Figure 3:
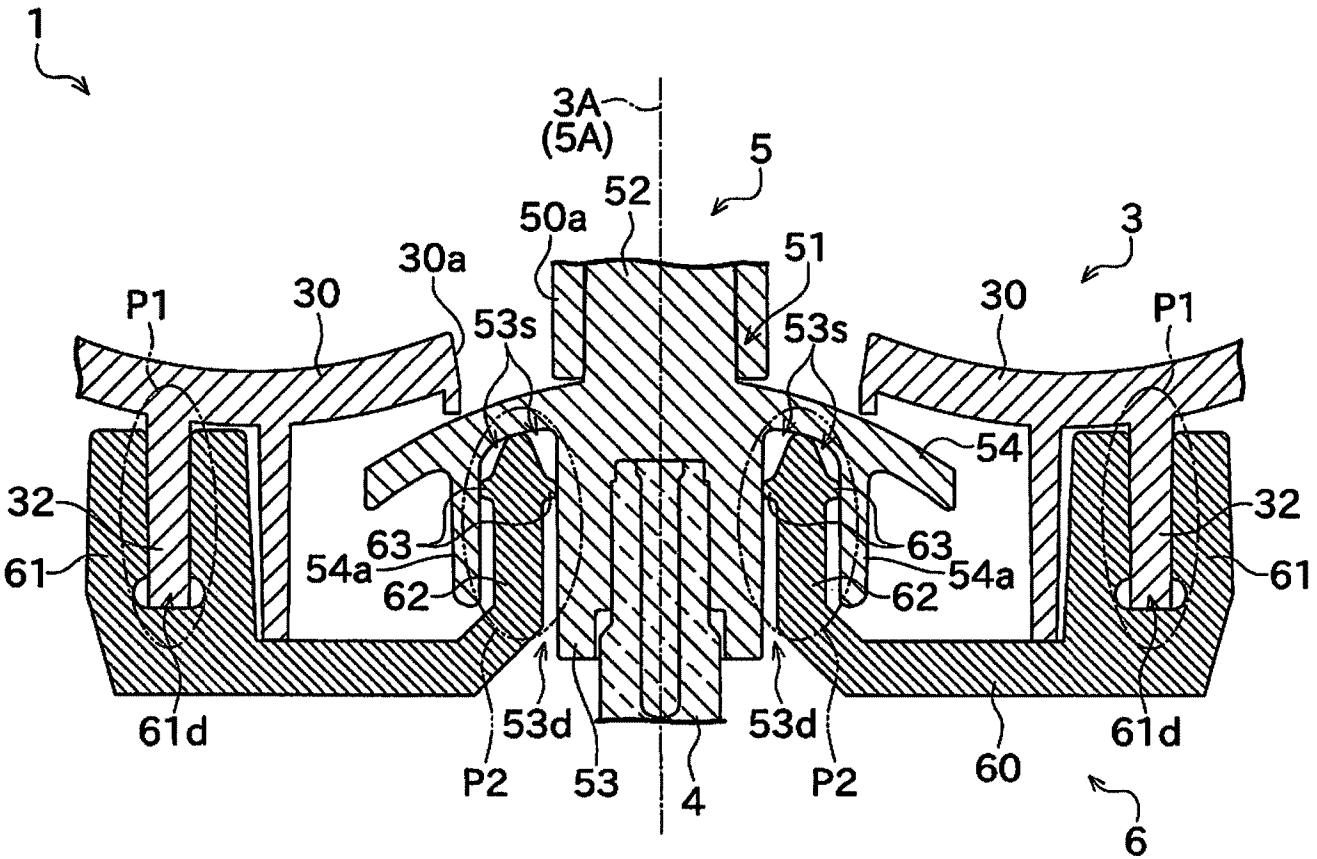
FIG. 3 is a cross section of when an operation dial and an operation knob are fixed to packing.

The configuration of the operation knob 5, the operation dial 3, and the packing 6 for achieving a multifunction joystick 1 that is waterproof and easy to operate, which is the characteristic feature of the present invention, will now be described through reference to FIGS. 3 and 4. FIG. 3 is a cross section of when the operation dial 3 and the operation knob 5 are fixed to the packing 6. FIG. 4 is an oblique view of the packing 6.

As shown in FIG. 3, the packing 6 is connected to the operation dial 3 at a first connection place P1 and to the operation knob 5 at a second connection place P2. More specifically, at the first connection place P1, the fixing rib 32 of the operation dial 3 is inserted into the fixing groove 61*d* formed in the fixing cylinder 61 of the packing 6, which connects the packing 6 and the operation dial 3 snugly together. At the second connection place P2, the sliding rib 62 formed around the inside of the packing 6 is inserted into the sliding groove 53*d* formed in the operation knob 5, which connects the packing 6 and the operation knob 5 snugly together.

First, we will describe how the operation dial 3 is fixed to the packing 6 at the first connection place P1.

At the first connection place P1, the width of the fixing groove 61*d* formed in the fixing cylinder 61 of the packing 6 is equal to the thickness of the fixing rib 32 of the operation dial 3 (however, the thickness of the fixing rib 32 may be greater than the width of the fixing groove 61*d*). Consequently, when the fixing rib 32 is inserted into the fixing groove 61*d*, they contact with no gap, over a wide area as shown in FIG. 3, allowing the operation dial 3 and the packing 6 to be snugly fitted together. As a result, good waterproofness can be achieved at the portion of the first connection place P1. Also, the operation dial 3 and the packing 6 are tightly fixed at the first connection place P1, and when the operation dial 3 is turned, the operation dial 3 and the packing 6 can be turned integrally. Furthermore, since the fixing rib 32 fits snugly in the fixing groove 61*d* so that the fixing rib 32 is flanked from both sides in the radial direction, even better waterproofness can be attained, and the components can be tightly fixed together.

How the operation knob 5 is fixed to the packing 6 at the second connection place P2 will now be described.

At the second connection place P2, annular lips (projection) 63 that protrude to the inside and outside in the radial direction are formed near the distal end of the sliding rib 62 of the packing 6. The lips 63 are formed so that the lips 63 protrude far enough to be pressed tightly against the inner walls of the sliding groove 53*d* when the sliding rib 62 is inserted into the sliding groove 53*d* formed in the operation knob 5. These two lips 63 provide a waterproof seal at the second connection place P2.

The sliding groove 53*d* and the lips 63 are in contact over a small area corresponding to the distal end of the two lips 63, as opposed to the fixing of the operation dial 3 and the packing 6 at the first connection place P1. In other words, at the portion other than the lips 63, none of the faces that face inside and outside in the radial direction of the packing 6 is in contact with the inner walls of the sliding groove 53*d*. As a result, the packing 6 can be turned relative to the operation knob 5 (the connecting member 51) by sliding the distal ends of the two lips 63 in the peripheral direction in the interior of the sliding groove 53*d*.

Also, the sliding rib 62 of the packing 6 and the plate component 60 between the sliding rib 62 and the fixing cylinder 61 is able to undergo elastic deformation. Therefore, the packing 6 deforms accordingly in response to the pushing in or the pivoting of the operation knob 5, which maintains the snug fit of the lips 63 to the inner walls of the sliding groove 53*d*, and as a result affords stable waterproofness.

Also, because the second connection place P2 is configured as above, water can be prevented from penetrating through the gap between the operation knob 5 and the packing 6, while the operation knob 5 and the packing 6 can be slid. This makes it easy to perform operations other than a rotary operation with the operation knob 5 while still maintaining a waterproof state. Also, since the lips 63 are formed on the sliding rib 62 located on the inside in the radial direction of the packing 6, the contact surface area between the packing 6 and the sliding groove 53*d* can be reduced. Therefore, compared to a configuration in which sliding is possible at the first connection place P1, there is less rotational resistance of the operation knob 5 with respect to the packing 6 when the operation dial 3 is turned, so the operation dial 3 can be turned with a small force. This makes the multifunction joystick 1 easier to operate.

Also, because the second connection place P2 is configured as above, an oil holding chamber 53*s* is formed between the operation knob 5 and the packing 6. This oil holding chamber 53*s* is formed in an annular shape deep in the sliding groove 53*d*, and is sealed off by the two lips 63. Good slidability of the two lips 63 can be maintained over an extended period by putting an oil compound or other such lubricant in the interior of this oil holding chamber 53*s*. Also, even if water should penetrate from the contact portion between the lips 63 and the sliding groove 53*d*, the water can be prevented from pass through by filling the oil holding chamber 53*s* with the above-mentioned lubricant. As a result, the waterproofness of the multifunction joystick 1 can be improved.

As discussed above, the packing 6, which is made of a waterproof material, is snugly fitted so as to be fixed with respect to the operation dial 3 at the first connection place P1, and is snugly fitted so as to be able to rotate and slide with respect to the operation knob 5 at the second connection place P2. Also, as shown in FIG. 2, the packing 6 is in contact with the operation dial 3 at the first connection place P1, and is in contact with the operation knob 5 at the second connection place P2, but is not in contact with any other members. In other words, the packing 6 touches and is supported by only the operation dial 3 and the operation knob 5, and does not touch any other members. Therefore, with these two connections, the packing 6 can prevent the incursion of water between the operation dial 3 and the operation knob 5, while the rotary operation by the operation dial 3 and the pivoting and pressing operations by the operation knob 5 can be carried out, all with a simple and inexpensive configuration.

As described above, the multifunction joystick 1 in this embodiment comprises the operation dial 3, the operation knob 5, and the packing 6. The operation dial 3 connects to the rotary encoder 2, which is capable of detecting rotary operation. The operation knob 5 connects to the joystick position sensor 4, which is capable of detecting operation that is different from the operation detected by the rotary encoder 2. The operation knob 5 is disposed on the rotational center side of the operation dial 3. The packing 6 is annular in shape. The packing 6 covers the gap between the operation dial 3 and the operation knob 5. The packing 6 contacts with and is supported by only the operation dial 3 and the operation knob 5.

By thus providing a waterproofing ring that contacts with and supports only the operation dial 3, which is capable of rotary operation, and the operation knob 5, which is capable of operation that is different from rotary operation, easy of operation of the rotary knob and the knob can be ensured, while also preventing the incursion of water into the interior through the gap between the rotary knob and the knob. As a result, a multifunction joystick 1 that is waterproof and is capable of rotary operation and operation other than rotary operation can be provided with a simple and inexpensive configuration.

Figure 5:
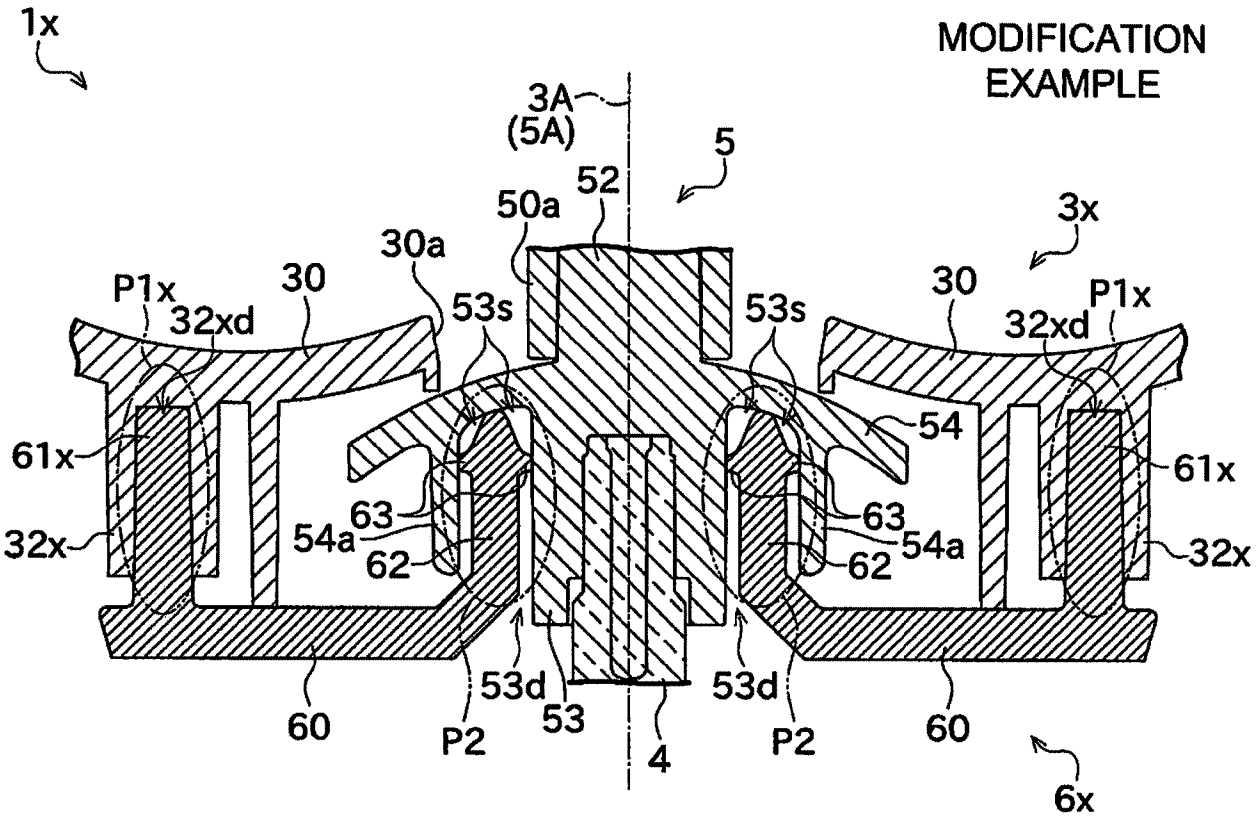
FIG. 5 is a cross section of when an operation dial and an operation knob are fixed to packing in a multifunction joystick in a modification example.

A modification example of the above embodiment will now be described. FIG. 5 is a cross section of when an operation dial 3*x* and the operation knob 5 are fixed to a packing 6*x* in a multifunction joystick 1*x* in a modification example. In the description of this modification example, members that are the same as or similar to those in the above embodiment are numbered the same in the drawing and will not be described again.

With the multifunction joystick 1*x* in the modification example shown in FIG. 5, at the outside portion of the packing 6*x*, a cylindrical fixing cylinder 32*x* that protrudes downward is formed on the operation dial 3*x*, and a fixing groove 32*xd* that opens downward is formed in this fixing cylinder 32*x*. Meanwhile, an annular fixing rib 61*x* that protrudes upward is provided on the packing 6*x* side, and this fixing rib 61*x* is inserted into the fixing groove 32*xd*. The rest of the configuration is the same as in the above embodiment, and therefore will not be described. Again with this configuration, the operation dial 3*x* and the packing 6*x* can be snugly fitted together and fixed at a first connection place P1*x*.

A preferred embodiment of the present invention is described above, but the above configuration can be modified as follows.

In the above embodiment, the fixing rib 32 shown in FIG. 2, etc., is annular in shape when viewed in a direction parallel to the rotational axis 3A of the operation dial 3. However, instead of this, the configuration may be such that the fixing rib 32 has some other closed shape (such as octagonal or another such polygonal shape). The same applies to the shape of the fixing rib 61*x* shown in FIG. 5.

Rather than forming just one set of the fixing rib 32 and the fixing groove 61*d* at the first connection place P1, two or more sets may be formed. Similarly, rather than forming just one set of the sliding rib 62 and the sliding groove 53*d* at the second connection place P2, two or more sets may be formed.

In the above embodiment, the configuration allowed detection of the tilting of the operation knob 5 in any direction around 360°, but the configuration may instead be such that the joystick position sensor 4 operates in just two directions, or four directions, or eight directions, for example.

In the above embodiment, the function of detecting either the pivoting operation or the pushing in operation of the operation knob 5 may be eliminated. That is, with the joystick position sensor 4, the configuration may be such that the operation knob 5 cannot be pushed in. Or, a push switch may be provided instead of the joystick position sensor 4, for example.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

Terminology

It is to be understood that not necessarily all objects or advantages may be achieved in accordance with any particular embodiment described herein. Thus, for example, those skilled in the art will recognize that certain embodiments may be configured to operate in a manner that achieves or optimizes one advantage or group of advantages as taught herein without necessarily achieving other objects or advantages as may be taught or suggested herein.

All of the processes described herein may be embodied in, and fully automated via, software code modules executed by a computing system that includes one or more computers or processors. The code modules may be stored in any type of non-transitory computer-readable medium or other computer storage device. Some or all the methods may be embodied in specialized computer hardware.

Many other variations than those described herein will be apparent from this disclosure. For example, depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. In addition, different tasks or processes can be performed by different machines and/or computing systems that can function together.

The various illustrative logical blocks and modules described in connection with the embodiments disclosed herein can be implemented or performed by a machine, such as a processor. A processor can be a microprocessor, but in the alternative, the processor can be a controller, microcontroller, or state machine, combinations of the same, or the like. A processor can include electrical circuitry configured to process computer-executable instructions. In another embodiment, a processor includes an application specific integrated circuit (ASIC), a field programmable gate array (FPGA) or other programmable device that performs logic operations without processing computer-executable instructions. A processor can also be implemented as a combination of computing devices, e.g., a combination of a digital signal processor (DSP) and a microprocessor, a plurality of microprocessors, one or more microprocessors in conjunction with a DSP core, or any other such configuration. Although described herein primarily with respect to digital technology, a processor may also include primarily analog components. For example, some or all of the signal processing algorithms described herein may be implemented in analog circuitry or mixed analog and digital circuitry. A computing environment can include any type of computer system, including, but not limited to, a computer system based on a microprocessor, a mainframe computer, a digital signal processor, a portable computing device, a device controller, or a computational engine within an appliance, to name a few.

Conditional language such as, among others, "can," "could," "might" or "may," unless specifically stated otherwise, are otherwise understood within the context as used in general to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Any process descriptions, elements or blocks in the flow diagrams described herein and/or depicted in the attached figures should be understood as potentially representing modules, segments, or portions of code which include one or more executable instructions for implementing specific logical functions or elements in the process. Alternate implementations are included within the scope of the embodiments described herein in which elements or functions may be deleted, executed out of order from that shown, or discussed, including substantially concurrently or in reverse order, depending on the functionality involved as would be understood by those skilled in the art.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C. The same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations).

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.).

For expository purposes, the term "horizontal" as used herein is defined as a plane parallel to the plane or surface of the floor of the area in which the system being described is used or the method being described is performed, regardless of its orientation. The term "floor" can be interchanged with the term "ground" or "water surface". The term "vertical" refers to a direction perpendicular to the horizontal as just defined. Terms such as "above," "below," "bottom," "top," "side," "higher," "lower," "upper," "over," and "under," are defined with respect to the horizontal plane.

As used herein, the terms "attached," "connected," "mated," and other such relational terms should be construed, unless otherwise noted, to include removable, moveable, fixed, adjustable, and/or releasable connections or attachments. The connections/attachments can include direct connections and/or connections having intermediate structure between the two components discussed.

Numbers preceded by a term such as "approximately", "about", and "substantially" as used herein include the recited numbers, and also represent an amount close to the stated amount that still performs a desired function or achieves a desired result. For example, the terms "approximately", "about", and "substantially" may refer to an amount that is within less than 10% of the stated amount. Features of embodiments disclosed herein are preceded by a term such as "approximately", "about", and "substantially" as used herein represent the feature with some variability that still performs a desired function or achieves a desired result for that feature.

It should be emphasized that many variations and modifications may be made to the above-described embodiments, the elements of which are to be understood as being among other acceptable examples. All such modifications and variations are intended to be included herein within the scope of this disclosure and protected by the following claims.

What is claimed is:

1. A manipulation device comprising:

a rotary knob rotatable about a rotational axis;

a button having a center axis on the rotational axis of the rotary knob; and a waterproofing ring that waterproofs a gap between the rotary knob and the button, the waterproofing ring rotating with the rotary knob, and the waterproofing ring being held in contact with the button and the rotary knob, the waterproofing ring having an annular protrusion that protrudes substantially parallel to the rotational axis of the rotary knob, the button having a groove, and the annular protrusion of the waterproofing ring being fitted into the groove of the button, an annular projection that protrudes inside and outside in a radial direction of the waterproofing ring is provided on the annular protrusion of the waterproofing ring, and the annular projection is pressed against an inner wall of the groove of the button to cause the button and the waterproofing ring to be fitted.

2. The manipulation device according to claim 1, wherein a sealed space is formed between the waterproofing ring and the button.

3. The manipulation device according to claim 2, wherein a lubricant is enclosed in the sealed space.

4. A manipulation device comprising:

a rotary knob rotatable about a rotational axis;

a button having a center axis on the rotational axis of the rotary knob and having a first groove that grooves substantially parallel to the rotational axis; and a waterproofing ring waterproofing a gap between the rotary knob and the button and having a first annular protrusion that protrudes substantially parallel to the rotational axis of the rotary knob, a second groove being grooved substantially parallel to the rotational axis on the rotary knob or the waterproofing ring, a second annular protrusion being protruded substantially parallel to the rotational axis on the waterproofing ring in case that the second groove is grooved on the rotary knob, or on the rotary knob in case that the second groove is grooved on the waterproofing ring, wherein the first annular protrusion is fitted into the first groove, and the second annular protrusion is fitted into the second groove.

5. The manipulation device according to claim 1, wherein the rotary knob has the second annular protrusion that protrudes substantially parallel to the rotational axis of the rotary knob, the waterproofing ring has the second groove, and the second annular protrusion of the rotary knob is fitted into the second groove of the waterproofing ring.

6. The manipulation device according to claim 1, wherein the waterproofing ring has the second annular protrusion that protrudes substantially parallel to the rotational axis of the rotary knob, the rotary knob has the second groove, and the second annular protrusion of the waterproofing ring is fitted into the second groove of the rotary knob.

7. The manipulation device according to claim 1, wherein an annular projection that protrudes inside and outside in a radial direction of the waterproofing ring is provided on the first annular protrusion of the waterproofing ring, and the annular projection is pressed against an inner wall of the first groove of the button to cause the button and the waterproofing ring to be fitted.

8. The manipulation device according to claim 7, wherein a sealed space is formed between the waterproofing ring and the button.

9. The manipulation device according to claim 8, wherein a lubricant is enclosed in the sealed space.

10. The manipulation device according to claim 4, wherein the button is tiltable relative to the center axis of the button.

11. The manipulation device according to claim 4, wherein the button is pushable in a direction of the rotational axis of the rotary knob.

12. The manipulation device according to claim 4, wherein the button is both tiltable relative to the center axis of the button and pushable in a direction of the rotational axis of the rotary knob.

13. The manipulation device according to claim 4, wherein the rotary knob connected to a first detector configured to detect a rotary operation; and the button connected to a second detector configured to detect a different operation from the rotary operation detected by the first detector.

14. A marine-use electronic device comprising the manipulation device according to claim 4.

* * * * *